US005594217A

United States Patent [19]

LeQuire

[11] Patent Number: 5,594,217

[45] Date of Patent: Jan. 14, 1997

[54] EXHAUST MUFFLER FOR SMALL MARINE CRAFT

[76] Inventor: Wayne A. LeQuire, 701 Southwind Rd., Maryville, Tenn. 37801

[21] Appl. No.: 512,935

[22] Filed: Aug. 9, 1995

[51] Int. Cl.[6] ..... F01N 7/12

[52] U.S. Cl. ..... 181/235; 181/238; 181/255; 181/259

[58] Field of Search ..... 181/235, 259, 181/260, 262, 238, 239, 255; 440/89

[56] References Cited

U.S. PATENT DOCUMENTS

| | | | |
|---|---|---|---|
| 2,360,429 | 6/1943 | Leadbetter . | |
| 2,498,979 | 9/1943 | Bourne . | |
| 3,077,240 | 2/1963 | Betts | 181/260 |
| 3,176,791 | 4/1965 | Betts et al. | 181/282 |
| 3,296,997 | 6/1965 | Hoiby . | |
| 4,002,136 | 1/1977 | Michalak | 181/235 |
| 4,713,029 | 12/1987 | Ford . | |
| 4,917,640 | 4/1990 | Miles, Jr. . | |
| 5,045,005 | 9/1991 | Miles, Jr. . | |
| 5,147,232 | 9/1992 | Miles, Jr. et al. . | |
| 5,259,797 | 11/1993 | Miles, Jr. . | |

*Primary Examiner*—Khanh Dang
*Attorney, Agent, or Firm*—Pitts & Brittian, P.C.

[57] ABSTRACT

An exhaust muffler for small marine craft that can be located in the rear portion of the bilge and straddle the drive shaft and the shaft log. The muffler has a shell formed from sides, ends, top and bottom walls. The bottom wall is provided with a concave depression to receive the shaft and shaft log. A preferred configuration of the depression is a semi-conical surface having a base proximate the inlet wall. Further, the top and bottom walls are configured to conform to the undersurface of the deck and the inside of the hull, respectively. An inlet pipe, or a multiple number of inlet pipes, receive exhaust gases and water from the exhaust manifold of the craft engine and direct this combination into the muffler above a water pool. Gases pass through the water pool and exit through an outlet pipe (or a plurality of outlet pipes). A downwardly extending conduit within the outlet pipe(s) provides a correct amount of lift such that an amount of water exits the muffler which is the same as the amount entering. Because of the shape and construction, this muffler can be placed within the bilge of the craft in a space that is normally waste.

16 Claims, 3 Drawing Sheets

EXHAUST MUFFLER FOR SMALL MARINE CRAFT

TECHNICAL FIELD

This invention relates to mufflers for the reduction of noise caused by internal combustion engines, and more particularly to mufflers utilized in marine craft. It is of particular importance in the field of small marine craft having a drive shaft connecting the engine to a propeller, this type of marine craft being referred to as "inboards".

BACKGROUND ART

One of the many types of marine craft is the "inboard", a boat with a motor permanently mounted within the boat, the motor driving a shaft to which a propeller is connected exterior the hull of the boat. This shaft passes through a "shaft log" in the hull that functions as a shaft bearing as well as a shaft seal.

In these types of marine craft, it is common practice to pass the engine exhaust gases through a muffler to reduce the exhaust sound. Further, such exhaust systems generally utilizes a portion of the motor coolant water as a coolant for the muffler. This is normally accomplished by adding the water to the exhaust gases prior to entrance into the muffler. Then, a portion of this water exits with the exhaust gases from the rear of the marine craft.

A large number of mufflers for marine craft are known in the art. For example, several are identified and described in U.S. Pat. Nos. 2,360,429 issued to R. Leadbetter on Oct. 17, 1944; 2,498,979 issued to R. Bourne on Feb. 28, 1950; 3,296,997 issued to J. Hoiby, et al on Jan. 10, 1967; 4,713,029 issued to J. Ford on Dec. 15, 1987; 4,917,640 issued to C. Miles, Jr. on Apr. 17, 1990; 5,045,005 issued to C. Miles, Jr. on Sep. 3, 1991; 5,147,232 issued to C. Miles, Jr., et al on Sep. 15, 1992; and 5,259,797 issued to C. Miles, Jr., et al on Nov. 9, 1993. Of course, these patents cite prior patents generally relevant to the technology.

The complexity of the prior art mufflers varies from the simple construction of Hoinby ('997) to the various complex constructions of those of Miles ('640, '005, '232, '797). The complex designs are expensive to construct because of the numerous components and their arrangement. Further, as illustrated in Ford, the prior art mufflers are conventionally installed immediately adjacent the exhaust manifold of the engine. For this reason, the size and configuration is not particularly limited. While this is possible for most inboard craft, in very small craft of the type useful for a single boater such muffler systems occupy a significant proportion of the region near the engine. Thus, the boat must be of sufficient size to accommodate the muffler.

Therefore, it is an object of the present invention to provide an exhaust muffler for small marine craft that can be placed in the bilge area of the small craft to minimize the total size of the craft.

Another object of the present invention is to provide an exhaust muffler for small marine craft that can be placed in an extreme rearward portion of the bilge area adjacent the motor shaft and shaft log of the craft.

A further object of the present invention is to provide an exhaust muffler for small marine craft that has a top surface to conform to the undersurface of the craft deck, and a bottom surface to conform to the inner surface of the craft hull, including the shaft and shaft log, whereby a minimum space is taken up by the muffler within the bilge of the craft.

It is also an object of the present invention to provide a marine exhaust muffler that is both light in weight and is easily fabricated so as to minimize cost.

These and other objects of the present invention will become apparent upon a consideration of the drawings identified below, and a complete description thereof.

SUMMARY OF THE INVENTION

In accordance with the present invention, there is provided an exhaust muffler for small marine craft that fits within the bilge of the craft. In order to accomplish occupying the least space within the bilge, the muffler has a top surface that fits against the underside of the deck, and a bottom surface that closely matches the interior of the hull of the craft. This bottom surface has a concave central depression such that this bottom surface fits around the shaft and shaft log of the craft. Inlet and outlet ports provide for the flow-through of exhaust gases and coolant water from the engine of the craft to external the stern of the craft.

BEST MODE FOR CARRYING OUT THE INVENTION

Figure 1:
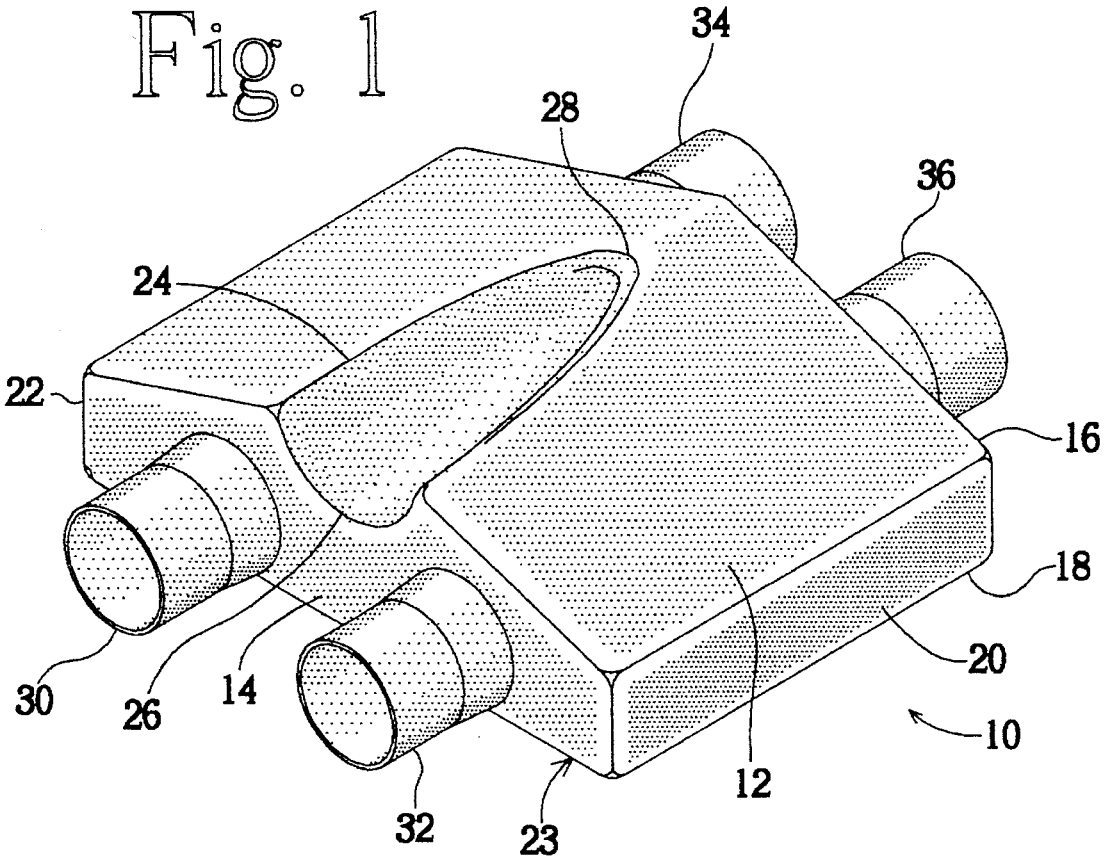
FIG. 1 is an isometric drawing of an exhaust muffler of the present invention, as inverted to better see the bottom surface.
Figure 2:
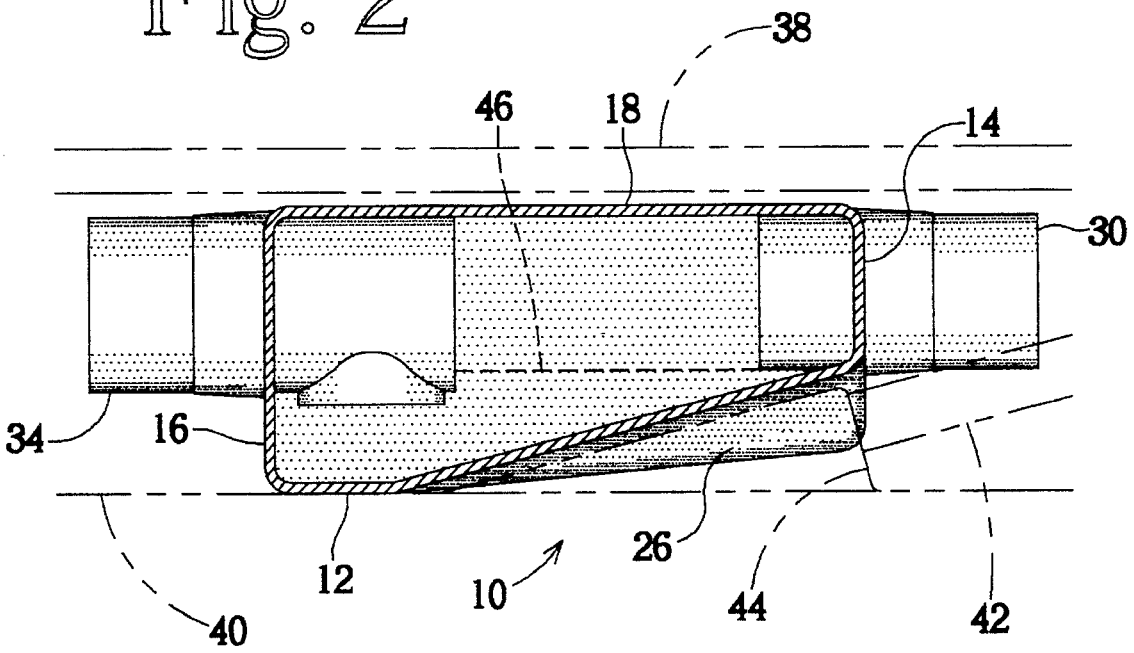
FIG. 2 is a cross-sectional drawing of the muffler of FIG. 1, as non-inverted, taken at 2—2 of FIG. 4, this drawing showing the bilge region between decking and the hull, as well as the shaft and shaft log of the marine craft.

An exhaust muffler for small marine craft to accomplish the above-stated objects is shown generally at 10 in the figures. Referring now to FIG. 1, shown therein in isometric form is such an exhaust muffler. It is shown inverted in this figure with the bottom wall 12, in general, being somewhat V-shaped to conform to the interior surface of a boat hull. The muffler has an inlet wall 14, an outlet wall 16, a top wall 18, and side walls 20, 22. As can be seen in FIG. 2, in a preferred embodiment the inlet wall 14 has a height less than that of the outlet wall 16 to further help conform to the interior surface of the hull of the boat. All walls are joined into an integral shell 23. The shell can be, for example, a fiberglass body to minimize weight and simplify fabrication; of course, other materials of construction are within the scope of the invention, such as stainless steel. Typically the shell 23 of the muffler 10 is fourteen inches from the inlet wall to the outlet wall; nineteen inches across between side walls; and an average thickness of six inches. Of course, other dimensions can be used without departing from the scope of the invention.

The bottom wall 12 is provided with a central concave portion 24 extending generally from the inlet wall 14 toward the outlet wall 16. The concave portion 24 can have any selected cross-section so as to receive the shaft and shaft log of the marine craft; however, in a preferred form for utilization of s pace and maximizing the interior of the muffler 10, the concave portion is a semi-conical depression. The "base" 26 of the conical shape is proximate the inlet wall 14, with the apex 28 directed toward the outlet wall 16. As discussed below, this concave portion 24 generally receives the drive shaft and shaft log of the craft. In the embodiment illustrated in FIG. 1 (and in FIG. 4), the muffler has two inlet pipes 30, 32. It also has two outlet pipes 34, 36. As will be discussed hereinafter, the present invention can be provided with any combination of such inlet and outlet pipes. Typically these pipes are about three and one-half to four inches in diameter.

Figure 4:
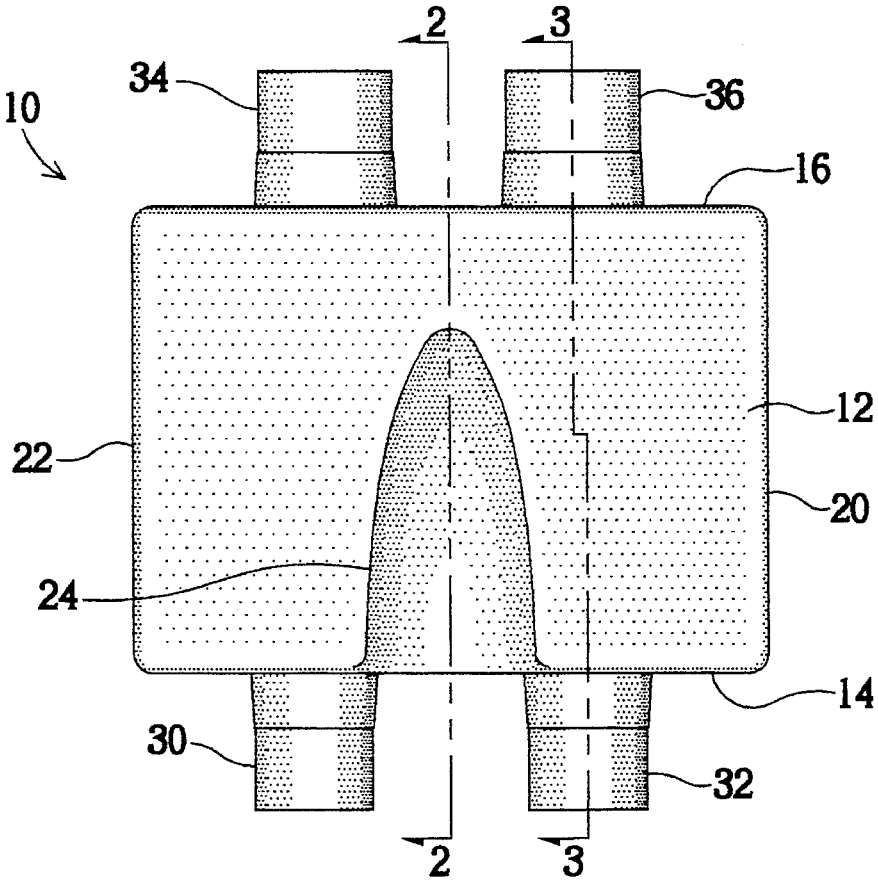
FIG. 4 is a bottom plan view of the muffler of FIG. 1.

Referring now to FIG. 2, this is a cross-sectional view of the muffler of FIG. 1 taken at 2—2 in FIG. 4. It is shown non-inverted, i.e., is its proper orientation. The environment for the muffler is also illustrated in this figure. For example, the floor or deck of the marine craft is shown at 38, as is the inner surface of the hull 40. The spacing between these is referred to as the "bilge". Also shown is the drive shaft 42 connected between the engine and the propeller, and the shaft log 44 that is both a bearing and a seal for the exit of the shaft 42 through the bottom of the hull 40. From this drawing it can be seen how the semi-conical concave region 26 permits the muffler 10 to be placed within the limited space of a craft bilge, as well as near the shaft 42 and the shaft log 44. This is a region that is normally waste space in any marine craft.

This FIG. 2 also illustrates how the inlet pipe 30 and the outlet pipe 34 penetrate their respective walls 14, 16. Conventionally the muffler 10 would contain a pool of water having a level proximate that shown by the dashed line 46. The actual level will vary according to the particular engine exhaust line, the amount of water entering with exhaust gas through the inlet pipe 30, and other considerations. The exhaust gases and coolant water enter through this inlet pipe 30 generally above the water pool. The exhaust gases then passes through that water pool to enter the bottom of the outlet pipe 34 (as will be shown in FIG. 3). The size of inlet pipe(s) 30, 32 and outlet pipe(s) 34, 36 are chosen to accommodate the quantity of exhaust gases produced by a given engine as is known in the art. If, for example, a single outlet pipe (e.g., 34) is utilized with two inlet pipes 30, 32, it would have a larger cross-sectional area than each pipe if two outlet pipes are utilized. The same would be true for a single inlet pipe (e.g., 30) versus a dual inlet.

Figure 3:
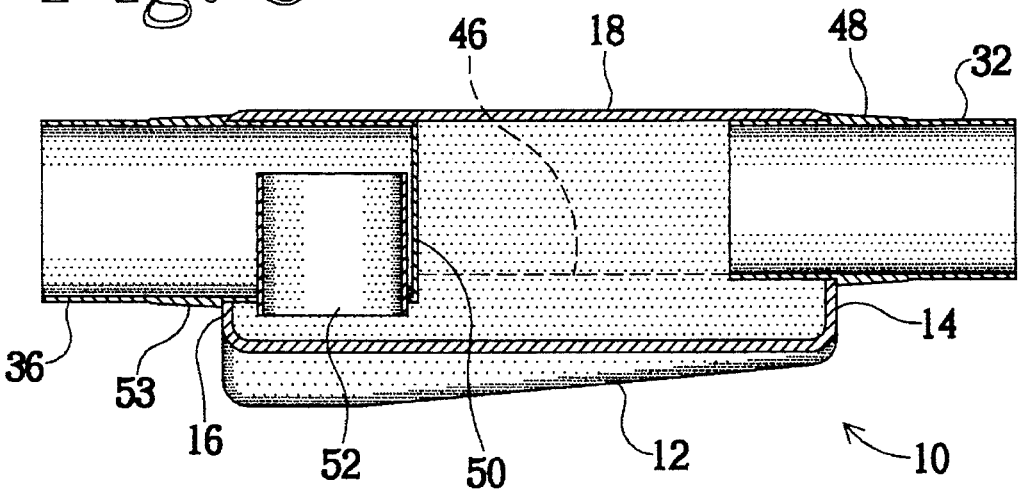
FIG. 3 is a cross-sectional drawing of the muffler of FIG. 1, as non-inverted, taken at 3—3 of FIG. 4.

The cross-sectional view of FIG. 3 provides information about the respective inlet and outlet pipes 32, 36. It can be seen that the inlet pipe 32 enters the inlet wall 14 and provides a straight-through flow of gases and water into the muffler 10. If desired, a reinforced area 48 can be provided on the inlet pipe 32 to assist in reinforcing a seal between the pipe and the wall. The same construction would apply to a second inlet pipe 30.

In contrast, the outlet pipe 36 terminates in a closure wall 50. The pipe 36 can have a reinforcing region 53 to facilitate and strengthen a seal between this pipe and the outlet wall 16. Intermediate the closure wall 50 and the outlet wall 16 the outlet pipe 36 is provided with a downwardly-extending side conduit 52 that extends below the water pool level 46 and provides communication between the water pool and the outlet pipe 36. This side conduit 52 extends up into the outlet pipe 36 a distance sufficient to give the desired lift of gases and water for exit from the muffler 10. Among other things, this maintains the desired water level in the muffler 10.

Figure 5:
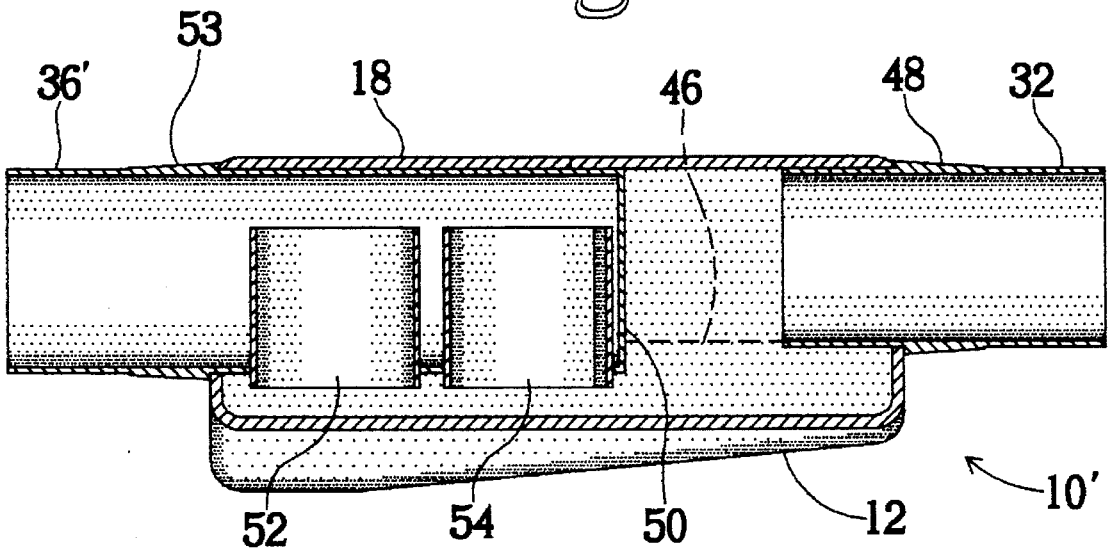
FIG. 5 is a cross-sectional drawing of another internal embodiment of a muffler shown in FIG. 1 taken at 3—3 of FIG. 4.

If two outlet pipes 34, 36 are utilized, each is configured as in FIG. 3. In some applications of the present muffler, only a single outlet pipe is utilized. In such instances, this pipe 34' would be provided with two side conduits 52, 54 as illustrated at 10' in FIG. 5. Other components of the muffler 10' would be the same as previously described.

Figure 6:
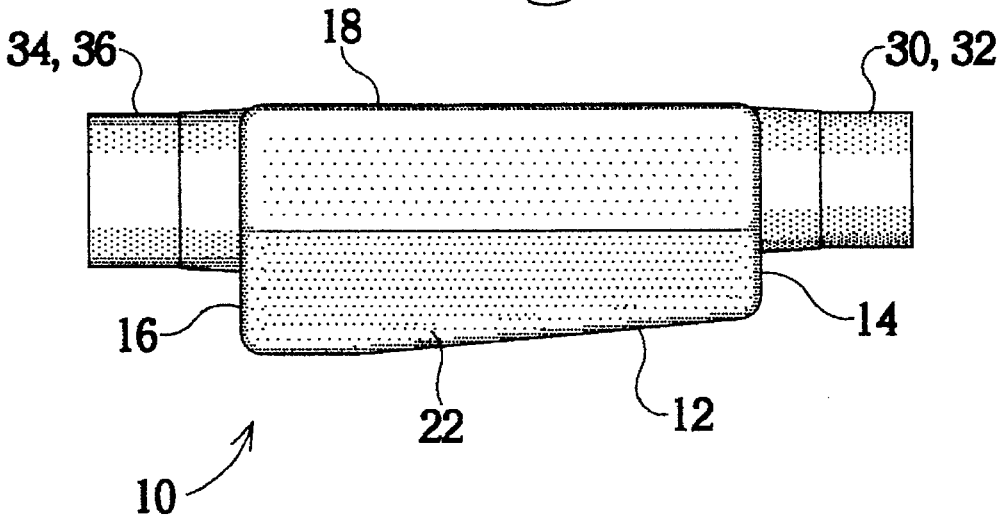
FIG. 6 is a side elevational view of the muffler of the present invention as shown in FIG. 1.

FIG. 6 is a side elevational view of the muffler 10. It is apparent that the inlet wall 14 can be made shorter than the outlet wall 16 whereby the bottom wall 12 slopes upwardly toward the front to better conform to the inner surface of a boat hull to maximize utilization of the space in the bilge.

In a normal operation of the present invention (either 10 or 10'), the muffler is placed in the bilge of the craft at a location adjacent the transom of the craft (not shown). This is in an region just toward the stern where the shaft 42 exits the hull 40 through the shaft log 44. The muffler 10 (or 10') is connected to the exhaust manifold of the engine (not shown) whereby exhaust gases containing some coolant water are introduced into the muffler via the inlet pipes 30, 32. In craft where no water is initially added to the exhaust gases, a separate water inlet line (not shown) can be provided for the muffler. This gas-water passes directly into the muffler 10 above the surface 46 of a water pool. The gases then pass through the water pool, and up through the conduit 52 (and 54 if present) into the outlet pipes 34, 36, carrying some water. The height of the conduit 52 within the outlet pipes determines the lift within the muffler such that water only in the amount entering the muffler will exhaust through the outlet pipes. The result is a high degree of silencing of the sound of the exhaust of the engine.

From the foregoing, one skilled in the art will recognize that an improved boat engine exhaust muffler has been provided that occupies a portion of the boat that is normally waste space. As such, an adequate muffler is provided for very small marine craft permitting a saving of space such that the craft can be made smaller.

Typical materials of construction and typical dimensions are given herein; however, these are not for limiting the present invention. Rather, the invention is to be limited only by the appended claims and their equivalents.

I claim:

1. An exhaust muffler for marine craft having a shaft exiting a hull proximate a transom through a shaft log, the muffler comprising:

a shell having an internal cavity defined by an inlet wall, an outlet wall oppositely disposed from said inlet wall, a top wall, oppositely disposed side walls and a bottom wall;

at least one inlet pipe penetrating said inlet wall to communicate with said cavity to convey at least exhaust gases from an engine into said cavity;

means for providing a water pool within said cavity to a selected height below said inlet pipe;

at least one outlet pipe penetrating said outlet wall to communicate with said water pool to convey the gases passing through said water pool to an exterior of the marine craft with an amount of water to maintain said water pool at substantially said selected height; and wherein said bottom surface of said shell is provided with a concave depression extending from proximate said inlet wall, toward said outlet wall, said depression to receive the shaft and shaft log of the marine craft.

2. The muffler of claim 1 wherein said concave depression is a substantially semi-conical surface having a base proximate said inlet wall and an apex extending toward said outlet wall.

3. The muffler of claim 1 wherein said top wall is configured to closely conform to an under surface of a deck of the marine craft.

4. The muffler of claim 1 wherein said bottom wall is configured from one said side wall to a second said side wall to closely conform to an inner surface of the hull of the marine craft.

5. The muffler of claim 1 wherein said inlet wall has a height less than a height of said outlet wall.

6. The muffler of claim 1 wherein said at least one inlet pipe and said at least one outlet pipe are tubular, and wherein said outlet pipe is provided with a downwardly-extending conduit, said conduit of said outlet pipe is tubular and extends upwardly into an outlet pipe to provide a selected lift whereby water is removed with exhaust gases from the muffler in an amount to maintain said selected level of said water pool.

7. The muffler of claim 1 wherein two inlet pipes and two outlet pipes communicate with said cavity, and wherein said two outlet pipes are provided with a downwardly-extending conduit for the flow of exhaust gases and water from the muffler.

8. The muffler of claim 6 wherein said means for establishing a selected level of a water pool within said cavity comprises providing water with the exhaust gases from the engine, with the amount of water exiting said outlet pipe being equal to an amount of water entering with the exhaust gases through said inlet pipe.

9. An exhaust muffler for marine craft having a shaft exiting a hull proximate a transom through a shaft log, the muffler comprising:

a shell having an internal cavity defined by an inlet wall, an outlet wall generally oppositely disposed from said inlet wall, a top wall, oppositely disposed side walls, and a bottom wall, said top wall configured to conform to an under surface of a deck of the marine craft, and said bottom wall configured between said side walls to conform to an inner surface of the hull of the marine craft;

at least one inlet pipe penetrating said inlet wall to communicate with said cavity to convey exhaust gases and water from an engine into said cavity;

a water pool within said cavity having a selected height below said inlet pipe;

at least one outlet pipe penetrating said outlet wall to communicate with said water pool to convey the gases passing through said water pool to an exterior of the marine craft with an amount of water to maintain said water pool at substantially said selected height; and wherein said bottom wall of said shell is provided with a substantially semi-conical depression with a base proximate said inlet wall, with the apex extending toward said outlet wall, the depression to receive the shaft and shaft log of the marine craft.

10. The muffler of claim 9 wherein said inlet wall has a height less than a height of said outlet wall.

11. The muffler of claim 9 wherein said at least one inlet pipe and said at least one outlet pipe are tubular, and wherein said outlet pipe is provided with a downwardly-extending conduit, said conduit of said outlet pipe is tubular and extends upwardly into an outlet pipe to provide a selected lift whereby water is removed with exhaust gases from the muffler in an amount to maintain said selected level of said water pool.

12. The muffler of claim 9 wherein two inlet pipes and two outlet pipes communicate with said cavity, and wherein said two outlet pipes are provided with a downwardly-extending conduit for the flow of exhaust gases and water from the muffler.

13. The muffler of claim 9 wherein two inlet pipes and one outlet pipe communicate with said cavity, and wherein said one outlet pipe is provided with two downwardly-extending conduits for the flow of exhaust gases and water from the muffler.

14. An exhaust muffler for marine craft having a shaft exiting a hull proximate a transom through a shaft log, the muffler comprising:

a shell having an internal cavity defined by an inlet wall, an outlet wall generally oppositely disposed from said inlet wall and being taller than said inlet wall, a top wall, oppositely disposed side walls, and a bottom wall, said top wall configured to conform to an under surface of a deck of the marine craft, and said bottom wall configured between said side walls to conform to an inner surface of the hull of the marine craft;

at least one tubular inlet pipe penetrating said inlet wall to communicate with said cavity to convey exhaust gases and water from an engine into said cavity;

a water pool within said cavity having a selected height below said inlet pipe;

at least one tubular outlet pipe penetrating said outlet wall, said outlet pipe having a tubular downwardly-extending conduit to communicate with said water pool to convey the gases passing through said water pool to an exterior of the marine craft with an amount of water to maintain said water pool at substantially said selected height; and wherein said bottom wall of said shell is provided with a substantially semi-conical depression with a base proximate said inlet wall, with the apex extending toward said outlet wall, the depression to receive the shaft and shaft log of the marine craft.

15. The muffler of claim 14 wherein two inlet pipes and two outlet pipes communicate with said cavity, and wherein said two outlet pipes are provided with a downwardly-extending conduit for the flow of exhaust gases and water from the muffler.

16. The muffler of claim 14 wherein two inlet pipes and one outlet pipe communicate with said cavity, and wherein said one outlet pipe is provided with two downwardly-extending conduits for the flow of exhaust gases and water from the muffler.

* * * * *